US010046380B2

(12) United States Patent
Keil et al.

(10) Patent No.: US 10,046,380 B2
(45) **Date of Patent: *Aug. 14, 2018**

(54) TWIST APPLICATION DEVICE WITH AN ADJUSTABLE DISTANCE BETWEEN THE CONDUCTOR ENDS

(71) Applicant: SCHLEUNIGER HOLDING AG, Thun (CH)

(72) Inventors: Uwe Keil, Hueckswagen (DE); Roland Kampmann, Witten (DE)

(73) Assignee: Schleuniger Holding AG, Thun (CH)

( * ) Notice: Subject to any disclaimer, the term of this patent is extended or adjusted under 35 U.S.C. 154(b) by 423 days.

This patent is subject to a terminal disclaimer.

(21) Appl. No.: 14/922,453

(22) Filed: Oct. 26, 2015

(65) Prior Publication Data

US 2016/0114375 A1 Apr. 28, 2016

(30) Foreign Application Priority Data

Oct. 24, 2014 (EP) ..... 14190317
Oct. 24, 2014 (EP) ..... 14190323

(51) Int. Cl.
*B21F 15/04* (2006.01)
*B65H 51/18* (2006.01)
(Continued)

(52) U.S. Cl.
CPC ..... *B21F 15/04* (2013.01); *B65H 51/18* (2013.01); *H01B 13/0207* (2013.01); *B65H 2701/341* (2013.01); *H01B 13/0003* (2013.01)

(58) Field of Classification Search
CPC ..... B21F 15/04; B21F 15/02; H01B 13/0207; H01B 13/26; B65H 51/18; B65H 51/08;
(Continued)

(56) References Cited

U.S. PATENT DOCUMENTS 6,289,944 B1 * 9/2001 Frommenwiler .. H01B 13/0207 140/149
9,416,488 B2 8/2016 Stier et al.

FOREIGN PATENT DOCUMENTS

CH 673 858 A5 4/1990
DE 10 2010 017 981 A1 10/2010
(Continued)

OTHER PUBLICATIONS

European Search Report Corresponding to 14 19 0317 dated Apr. 10, 2015.

(Continued)

*Primary Examiner* — Teresa M Ekiert
(74) *Attorney, Agent, or Firm* — Davis & Bujold PLLC; Michael J. Bujold

(57) ABSTRACT

A twist application device, including a feeder (1) for feeding conductor ends (2*a* . . . 2*c*) of at least two conductors (3*a* . . . 3*c*), and a rotatably mounted twist application head (4) for twisting the said conductors (3*a* . . . 3*c*). The twist application device also includes a controller (7), connected with a drive (8) for first clamping jaws (5*a* . . . 5*f*) of the feeder (1), and is equipped for control of the latter. The distance (a) between clamped conductor ends (2*a* . . . 2*c*) is set at an adjustable value before the transfer of the conductor ends (2*a* . . . 2*c*) from the feed device (1) into the twist application head (4). A method of twisting at least two conductors (3*a* . . . 3*c*), in which the referred-to distance (a) is set at an adjustable value before clamping of the conductor ends (2*a* . . . 2*c*) in the second jaws (6*a*, 6*b*) of the twist application head (4). In alternative aspect, a feed device (1) for feeding conductor ends (2*a* . . . 2*c*) of conductors (3*a* . . . 3*c*) into a further processing device (4). The feed device (1) has first clamping jaws (5*a* . . . 5*f*), and the further processing device (4) has second clamping jaws (6*a*, 6*b*) for accepting and clamping the conductor ends (2*a* . . . 2*c*). The
(Continued)

Figure 1:
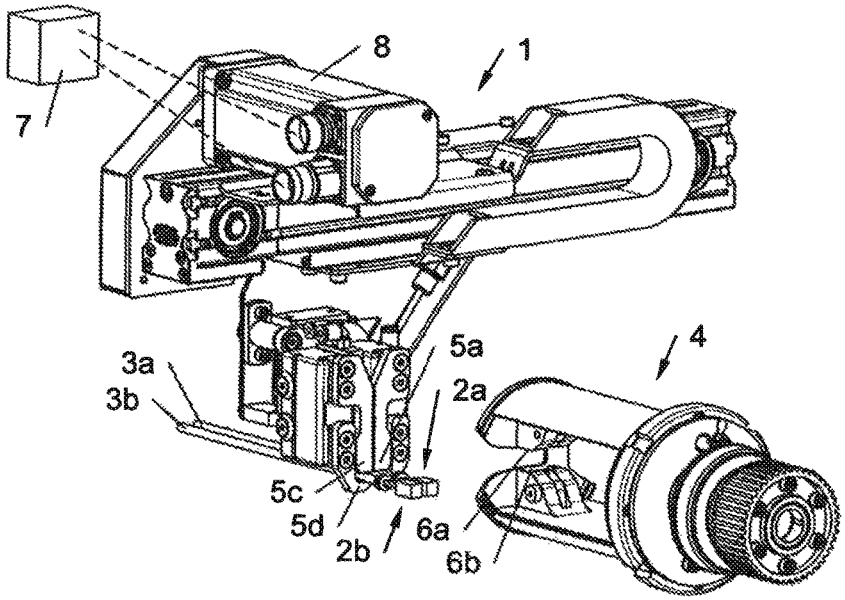

first jaws (5*a* . . . 5*f*) in a clamping position can be relatively moved so that distance (a) between ends (2*a* . . . 2*c*) may be altered. An intermediate space, located between first jaws (5*a* . . . 5*f*), extends, in a direction of movement (A) for altering the distance between clamped ends (2*a* . . . 2*c*), at least twice as far as in a clamping direction (B). Also a method, in which a variable position of the first jaws (5*a* . . . 5*f*) is adjusted in accordance with a selected distance (a) between the ends (2*a* . . . 2*c*) before clamping of the ends (2*a* . . . 2*c*), and the first jaws (5*a* . . . 5*f*) are moved into a prescribed position before the clamping of the ends (2*a* . . . 2*c*) in the second jaws (6*a,* 6*b*) of the further processing device (4).

16 Claims, 10 Drawing Sheets

(51) Int. Cl.
*H01B 13/00* (2006.01)
*H01B 13/02* (2006.01)

(58) Field of Classification Search
CPC ..... B65H 2701/341; E04G 21/1233; E04G 21/122
See application file for complete search history.

(56) References Cited

FOREIGN PATENT DOCUMENTS

| | | | |
|---|---|---|---|
| EP | 0 984 530 | A1 | 3/2000 |
| EP | 1 302 095 | A1 | 8/2000 |
| WO | 2013/068990 | A1 | 5/2013 |

OTHER PUBLICATIONS

European Search Report Corresponding to 14 19 0323 dated Apr. 10, 2015.

* cited by examiner

TWIST APPLICATION DEVICE WITH AN ADJUSTABLE DISTANCE BETWEEN THE CONDUCTOR ENDS

This application claims benefit of priority to prior European (EPO) application no. EP14190317 filed on Oct. 24, 2014 and also to prior European (EPO) application no. EP14190323 filed on Oct. 24, 2014, and the entireties of both prior European application no. EP14190317 and of prior European application no. EP14190323 are hereby expressly incorporated herein by reference, in their entireties and as to all their parts, for all intents and purposes, as if set forth identically in full herein.

The present disclosure relates to twist application devices that include a feed device for feeding conductor ends of at least two conductors, and that include a twist application head mounted such that it can rotate, for twisting the conductors. The feed device has first clamping jaws for clamping the conductor ends, and the twist application head has second clamping jaws for purposes of clamping the conductor ends. The feed device and the twist application head may be moved relative to one another into a transfer position, in which the first clamping jaws and the second clamping jaws are located opposite one another. In a clamping position, moreover, the first clamping jaws may be moved relative to one another such that a distance between clamped conductor ends may be altered.

In aspects, the present disclosure concerns a feed device for purposes of feeding conductor ends of at least two conductors into a further-processing device for the said conductors. The feed device has first clamping jaws for clamping the conductor ends, and the further-processing device has second clamping jaws for clamping the conductor ends. The feed device and the further-processing device can be moved relative to one another into a transfer position, in which the first clamping jaws and the second clamping jaws are located opposite one another. In a clamping position, moreover, the first clamping jaws can be moved relative to one another such that a distance between clamped conductor ends can be altered.

The present disclosure furthermore concerns a method for twisting at least two conductors with the aid of a feed device with first clamping jaws and a twist application device with a twist application head with second clamping jaws. Conductor ends of the conductors are thereby clamped between the first clamping jaws of the feed device, and the feed device is moved into a transfer position with the twist application head, in which the first clamping jaws of the feed device and the second clamping jaws of the twist application head are located opposite one another. The conductor ends are then clamped between the second clamping jaws of the twist application head, the first clamping jaws of the feed device are released, and the conductors are twisted by rotation of the twist application head.

In aspects, the present disclosure concerns a method for clamping at least two conductors with the aid of a feed device with first clamping jaws and for transferring the conductors to a further-processing device with second clamping jaws. Conductor ends of the said conductors are thereby clamped between the first clamping jaws of the feed device, and the feed device is moved into a transfer position with the further-processing device, in which the first clamping jaws of the feed device and the second clamping jaws of the further-processing device are located opposite one another. The conductor ends are then clamped between the second clamping jaws of the further-processing device, and the first clamping jaws of the feed device are released.

Further processing of the said conductors is then undertaken in the further-processing device.

A twist application device, together with a method for twisting two conductors of the type mentioned above, are in principle known from the prior art. EP1032095A2 discloses a method and a device for processing and twisting a pair of conductors. In the twist application device, the leading conductor ends are fed from a first pivoting unit to a first automatic device for processing and fitting. An extraction carriage then accepts the leading conductor ends and pulls the conductors out to the desired length. A feed device accepts the leading conductor ends and brings these to a twist application head. The lagging conductor ends are accepted by a second pivoting unit and fed to a second automatic device for processing and fitting. A transfer module accepts the finished lagging conductor ends and transfers these to a holding module. The conductor pair located between holding module and twist application head are twisted and elongated with a controlled tensile force.

In general, the aim is to twist conductors over the total length as far as possible. The distance between the conductor ends during the twisting process has a large influence on the shortest length for the non-twisted end section that can be achieved. The larger the distance between the conductor ends, the longer is the undesired non-twisted end section, as a rule. However, the distance between the conductor ends cannot be reduced in an arbitrary manner, in particular because conductor ends with fitted seals and/or contacts are also processed.

In accordance with the prior art, therefore, the feed device and the twist application head are designed to the largest distance occurring between the conductor ends, as a result of which the non-twisted end section is only as short as possible, if the conductor ends—for example as a result of fitted seals and contacts—cannot be arranged at a smaller distance than that in the twist application head. All other twisted conductors (and this represents the majority) accordingly have a non-twisted end section that is too long.

A very similar problem also presents itself under circumstances when fitting a seal and/or a (crimped) contact, in particular, if a seal and/or a contact is provided for the accommodation of a plurality of conductors and various seals and/or contacts are to be processed. Needless to say, however, the cited problem also presents itself if individual seals and/or contacts are to be fitted onto a plurality of conductors at the same time.

An object of the present disclosure is therefore to specify an improved twist application device and an improved method for purposes of twisting conductors. In particular, the non-twisted end section should be as short as possible. Advantageous developments are presented in the figures and in the totality of the present disclosure which includes the claims.

In aspect, an object of the present disclosure is therefore to specify an improved feed device, and an improved method for the transfer of conductors. In particular the feed device should be able to be deployed in various circumstances, and in particular, when applied in a twist application device, it should ensure that the non-twisted end section is kept as short as possible.

In accordance with the present disclosure, a twist application device of the type cited in the introduction also includes a controller that is connected with a drive for the first clamping jaws and that is equipped for the control of the latter so that the distance between clamped conductor ends is set at an adjustable value before the transfer into the twist application head.

In accordance with the present disclosure, the distance between clamped conductor ends in a method of the type mentioned in the introduction is brought into an adjustable value by movement of the first clamping jaws into a clamping position before the clamping of the conductor ends in the second clamping jaws of the twist application head.

Here, it is advantageous if at least two different values may be selected for the distance between the clamped conductor ends. However, it is also conceivable that the conductor ends are measured (e.g., optically) and a (minimum) distance is automatically set.

The design of the twist application device and the functional sequences in the same enable the conductor ends to be twisted with a variable distance relative to one another. Thin conductors, with small (crimped) contacts and small seals as necessary, may be arranged with a smaller distance between them than conductors with a large external diameter, in particular those that are fitted with large volume (crimped) contacts and seals. In this manner, the conductors may be twisted to the greatest possible length. In other words, the non-twisted conductor ends may remain as short as possible. Moreover, a required conductor separation, together with a required non-twisted conductor length, may be well maintained Further in accordance with the present disclosure, an intermediate space located between fully-open first clamping jaws, in a direction of movement for purposes of altering the distance between the clamped conductor ends, extends at least twice as far as in a clamping direction of the first clamping jaws for purposes of clamping the conductor ends.

In this regard, in particular the cited intermediate space, in a direction of movement for purposes of altering the distance between the clamped conductor ends, can be at least twice as large as a diameter of the conductor ends for which the feed device is specified. Moreover, it is also of advantage if the cited intermediate space, in a direction of movement for purposes of altering the distance between the clamped conductor ends, is at least 9 mm in size.

In accordance with the present disclosure a variable position of the first clamping jaws is set in accordance with a selected distance between the conductor ends before the clamping of the conductor ends, and the first clamping jaws are moved into a fixed prescribed position before the clamping of the conductor ends in the second clamping jaws of the further-processing device.

Here it is advantageous if at least two different values can be selected for the distance between the clamped conductor ends. However, it is also conceivable that the conductor ends are measured (e.g. optically) and a (minimum) distance is automatically set.

By the proposed measures the conductor ends may be clamped by the feed device in the first clamping process in different positions, and thus at different distances relative to one another. The design of the feed device and the functional sequences in the same thus enable the conductor ends, with a variable distance relative to one another, to be transferred to a further-processing device. Thin conductors, with small (crimped) contacts and small seals as necessary, may be arranged with a smaller distance between them than conductors with a large external diameter, in particular those that are fitted with large volume (crimped) contacts and seals.

In particular, but not exclusively, the feed device as presented is suitable for the transfer of the conductors into a twist application head, mounted such that it can rotate, which then forms or comprises the further-processing device. In this manner the conductors may be twisted to the greatest possible length, in other words the non-twisted conductor ends may remain as short as possible. Moreover, a required conductor separation, together with a required non-twisted conductor length, can be well maintained. However, the further-processing feed device may also undertake another task. It can, for example, push a seal onto the conductors, and/or fit (crimped) contacts onto the conductor ends.

In accordance with the proposed method the conductors are clamped in an adjustable position in the first clamping jaws. The set distance between the conductor ends ensues as a consequence, in that the first clamping jaws and the second clamping jaws are moved relative to one another into a fixed prescribed transfer position.

Further advantageous configurations and developments according to the present disclosure ensue from the totality of the description in conjunction with the drawing figures.

It may be advantageous if an intermediate space located between fully-open first clamping jaws, in a direction of movement for purposes of altering the distance between the clamped conductor ends, extends at least twice as far as in a clamping direction of the first clamping jaws for purposes of clamping the conductor ends. In particular, the cited intermediate space in a direction of movement for purposes of altering the distance between the clamped conductor ends may be at least twice as large as a diameter of the conductor ends for which the feed device is specified. Finally, it is also of advantage if the cited intermediate space in a direction of movement for purposes of altering the distance between the clamped conductor ends is at least 9 mm in size. In this manner, the conductor ends may be clamped by the feed device in the first clamping process in different positions, and thus at different distances relative to one another.

It may be particularly advantageous if the first clamping jaws have clamping surfaces facing towards one another, that a) are essentially flat, or, b) comprise more than one, in particular more than two, half-shell shaped grooves for purposes of accommodating one conductor end in each case.

Case a) enables the clamping process to take place in an arbitrary position. The first clamping process may also be supplied with teeth for a secure grip, whereby the height of the teeth is advantageously less than 10% of the conductor diameter, and/or is less than 3% of the distance of the first clamping jaws in the clamping direction when the first clamping jaws are fully-open, and/or is less than 0.3 mm. The clamping surfaces are then still essentially flat. Case b) finally enables the clamping of the conductor ends at a plurality of prescribed positions.

It may also be particularly advantageous if the second clamping jaws have clamping surfaces facing towards one another, which c) are essentially flat, or, d) comprise more than two, in particular more than three, half-shell shaped grooves for purposes of accommodating one conductor end in each case.

The statements made concerning the first clamping jaws apply here in an analogous manner.

It may moreover be favorable if the first clamping jaws in a clamping position may be moved relative to one another such that a distance between two clamped conductor ends may be altered. In this manner twisted-pair conductors may be manufactured with conductor ends that are variously spaced apart.

It may moreover be favorable, if the first clamping jaws in a clamping position may be moved relative to one another such that a distance between three clamped conductor ends may be altered. In this manner three-wire twisted conductors may be manufactured with conductor ends that are variously spaced apart.

It may moreover be favorable if the first clamping jaws and/or second clamping jaws are mounted such that they may move relative to one another for purposes of clamping a conductor end. By this, precise clamping is possible, or rather the precise maintenance of a required distance between the conductor ends.

It may moreover be favorable if the first clamping jaws, for purposes of altering the distance between the clamped conductor ends, are mounted such that they may be rotated relative to one another without affecting a clamping position. By this, a simple design of structure ensues for the feed device.

In a method presented, it may be of advantage if the conductor ends are captured and clamped by the feed device individually and in sequence, and are captured and clamped by the twist application head jointly and simultaneously. In this manner, the conductor ends may always be gripped by the feed device at the same position, as a result of which a simple design of structure of that device ensues, with which the conductors to be twisted may be transported onwards.

However, it may be also advantageous if the conductor ends are captured and clamped by the feed device jointly and simultaneously, and by the twist application head jointly and simultaneously. In this manner the processing speed, that is, the through-flow, may be increased.

It may be furthermore advantageous if a variable position of the first clamping jaws is set in accordance with a selected distance between the conductor ends before the clamping of the conductor ends, and if the first clamping jaws are moved into a fixed prescribed position before the clamping of the conductor ends in the second clamping jaws of the twist application head. In this variant, the conductors are therefore clamped in an adjustable position in the first clamping jaws. The set distance between the conductor ends ensues as a consequence, in that the first clamping jaws and the second clamping jaws are moved relative to one another into a fixed prescribed transfer position.

Finally, it may also be advantageous if the first clamping jaws are moved into a fixed prescribed position before the clamping of the conductor ends, and a variable position of the first clamping jaws is set in accordance with a selected distance between the conductor ends before the clamping of the conductor ends in the second clamping jaws of the twist application head. In this variant, the conductors are therefore always clamped in the same position in the first clamping jaws. The set distance between the conductor ends ensues as a consequence, in that the first clamping jaws and the second clamping jaws are moved relative to one another into an adjustable transfer position.

In further aspects, it may be advantageous if the feed device includes a controller that is connected with a drive for the first clamping jaws, and is equipped for the control of the latter such that the distance between clamped conductor ends is set at an adjustable value before the transfer into the twist application head. In this manner, the distance between the conductors may be adjusted automatically.

In this regard, it may be particularly advantageous if the first clamping jaws have clamping surfaces facing towards one another, which a) are essentially flat; or, b) comprise more than one, in particular more than two, half-shell shaped grooves for purposes of accommodating one conductor end in each case.

Case a) enables the clamping process to take place in an arbitrary position. The first clamping process may also be supplied with teeth for a secure grip, whereby the height of the teeth is advantageously less than 10% of the conductor diameter, and/or is less than 3% of the distance of the first clamping jaws in the clamping direction when the first clamping jaws are fully open, and/or is less than 0.3 mm. The clamping surfaces are then still essentially flat. Case b) finally enables the clamping of the conductor ends at a plurality of prescribed positions.

It may also particularly advantageous if the second clamping jaws have clamping surfaces facing towards one another, which c) are essentially flat; or, d) comprise more than two, in particular more than three, half-shell shaped grooves for purposes of accommodating one conductor end in each case.

The statements made concerning the first clamping jaws apply here in an analogous manner.

It may moreover be favorable if the first clamping jaws in a clamping position can be moved relative to one another such that a distance between two clamped conductor ends can be altered. In this manner twisted-pair conductors may be manufactured with conductor ends that are variously spaced apart.

It may moreover be favorable if the first clamping jaws in a clamping position can be moved relative to one another such that a distance between three clamped conductor ends may be altered. In this manner, three-wire conductors with conductor ends that are variously spaced apart may be transferred to a further-processing device. For example, the conductors may then be twisted, or a seal may be pushed onto the conductor ends, or contacts may be fitted onto the conductor ends. Needless to say, the activities cited may also be executed collectively by a further-processing device.

It may moreover be favorable if the first clamping jaws and/or second clamping jaws are mounted such that they can move relative to one another for purposes of clamping a conductor end. By this, precise clamping is possible, or rather the precise maintenance of a required distance between the conductor ends.

It may moreover be favorable if the first clamping jaws, for purposes of altering the distance between the clamped conductor ends, are mounted such that they may be rotated relative to one another without affecting a clamping position. By this, a simple design of structure ensues for the feed device.

In this aspect, as to the method presented it may be of advantage if the conductor ends are captured and clamped by the feed device individually and in sequence, and are captured and clamped by the further-processing device jointly and simultaneously. In this manner the conductor ends may always be gripped by the feed device at the same position, as a result of which a simple design of structure of that device ensues, with which the conductors to be further processed may be transported onwards.

However, it may also be advantageous if the conductor ends are captured and clamped by the feed device jointly and simultaneously, and by the further-processing device jointly and simultaneously. In this manner the processing speed, that is, the through flow, may be increased.

At this point, it should be noted that the variants disclosed with respect to the twist application device and the advantages resulting therefrom relate to an equal extent to the disclosed method, and vice versa. At this point it should also be noted that the variants disclosed with respect to the feed device and the advantages resulting therefrom relate to an equal extent to the disclosed method, and vice versa.

Further advantages, features and details according to the present disclosure ensue from the following description, in which examples are described with reference to the appended drawing figures. Here, the features mentioned in the claims and in the description may in each case, either individually or in any combination, be essential to aspects of the disclosure.

Figure 2:
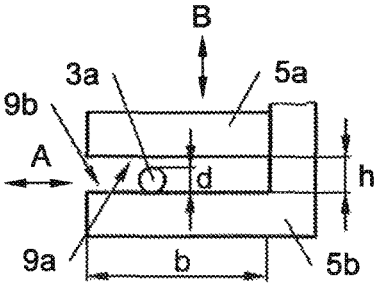
Figure 3:
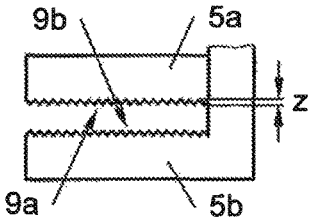
Figure 4:
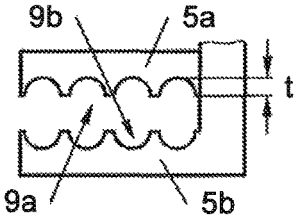
Figure 5:
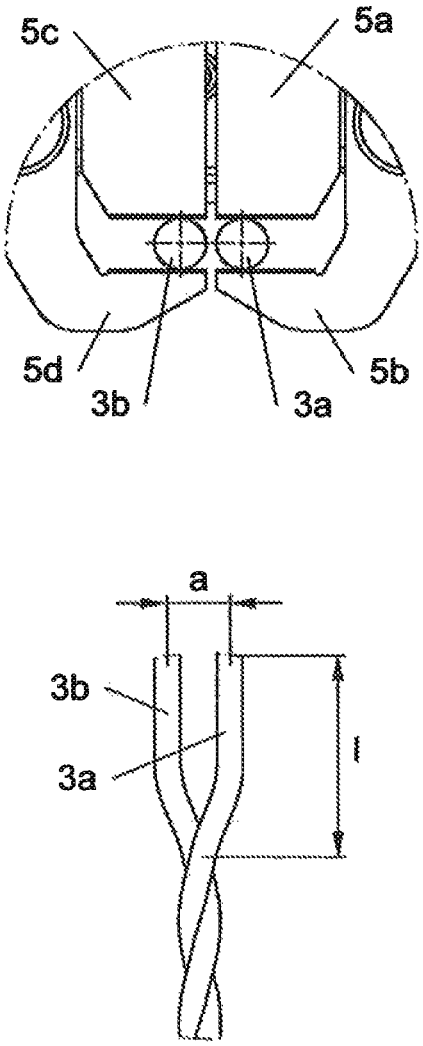
Figure 6:
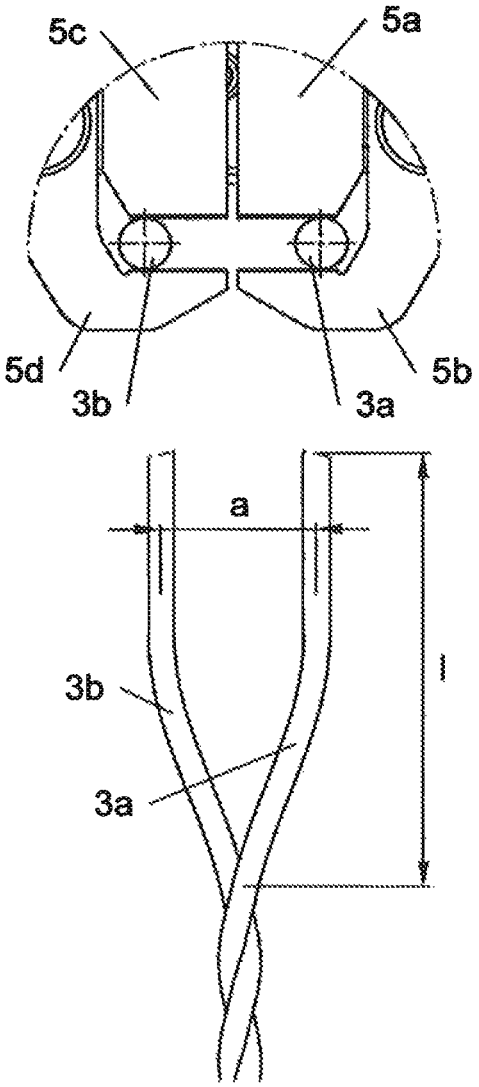
Figure 7:
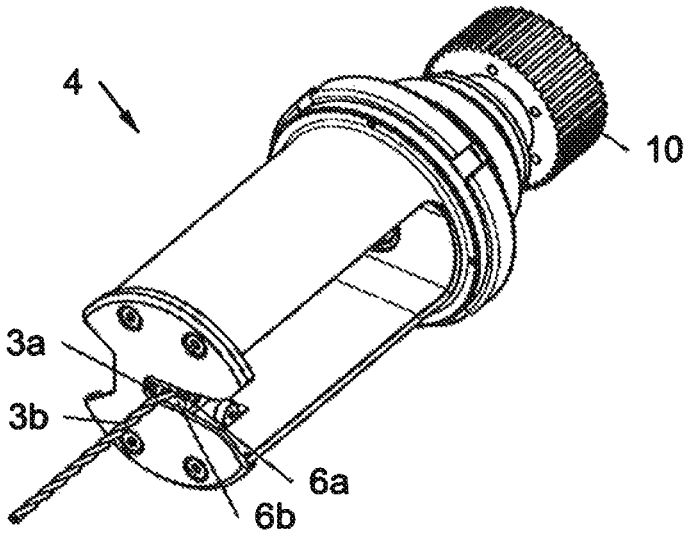
Figure 8:
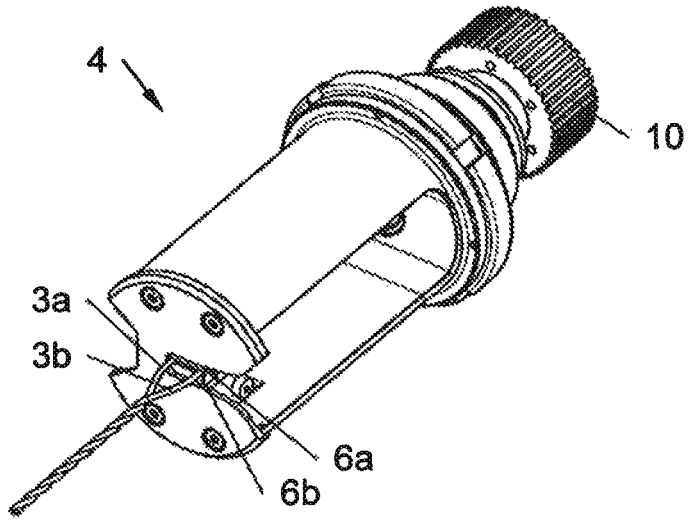
Figure 9:
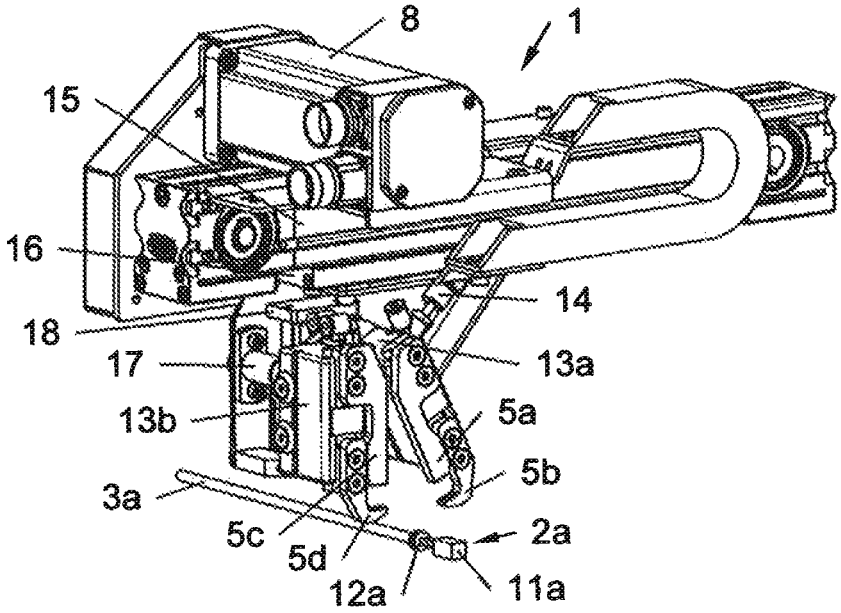
Figure 10:
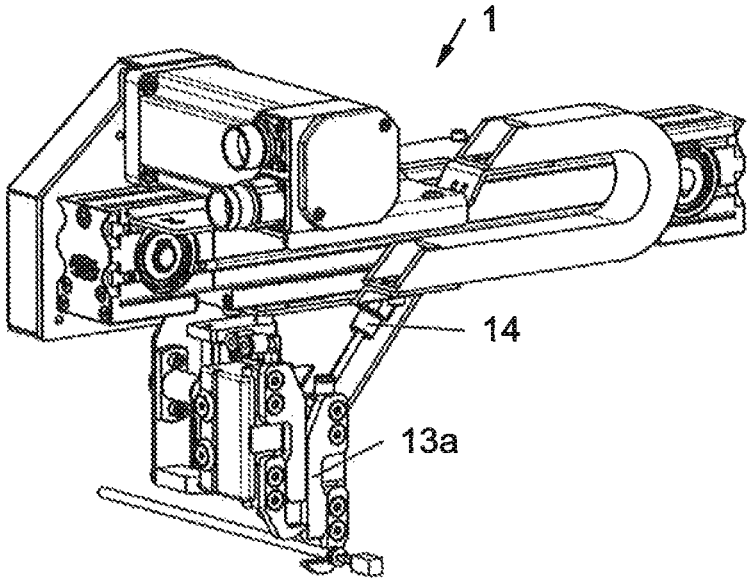
Figure 11:
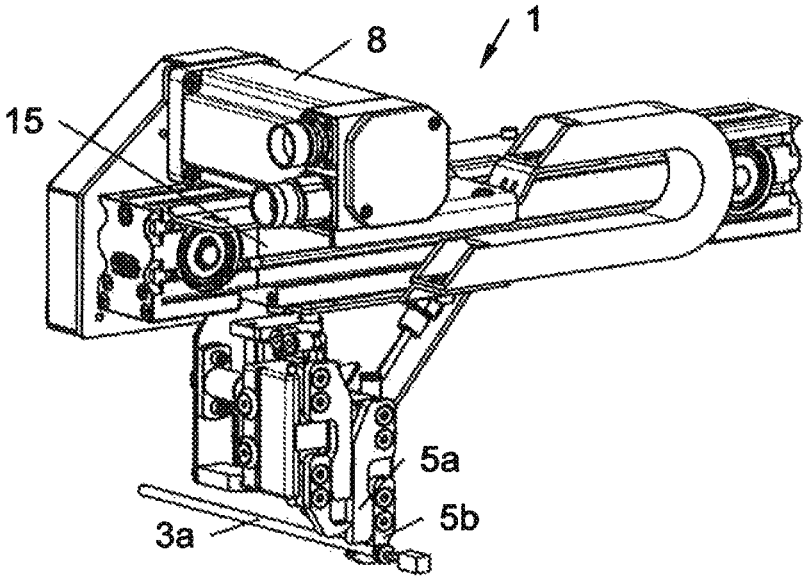
Figure 12:
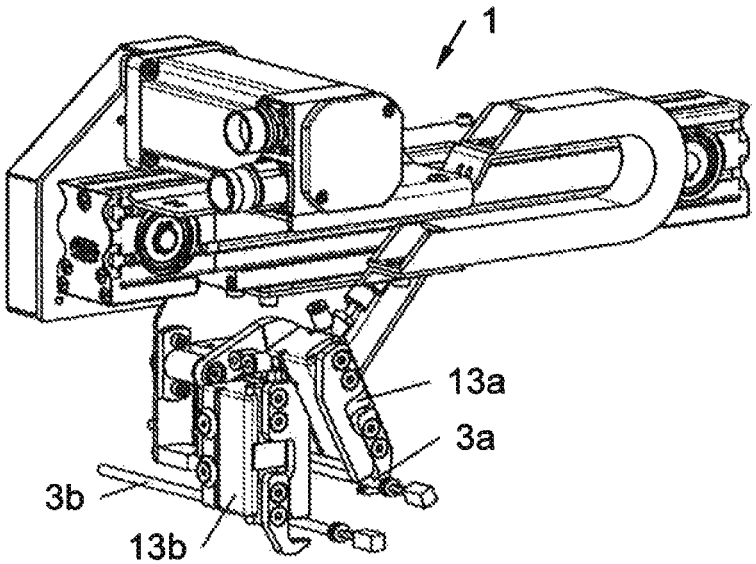
Figure 13:
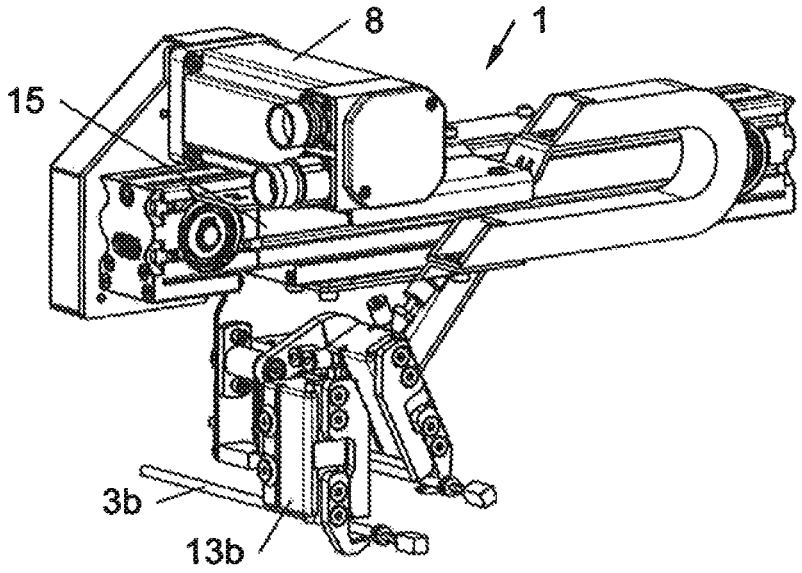
Figure 14:
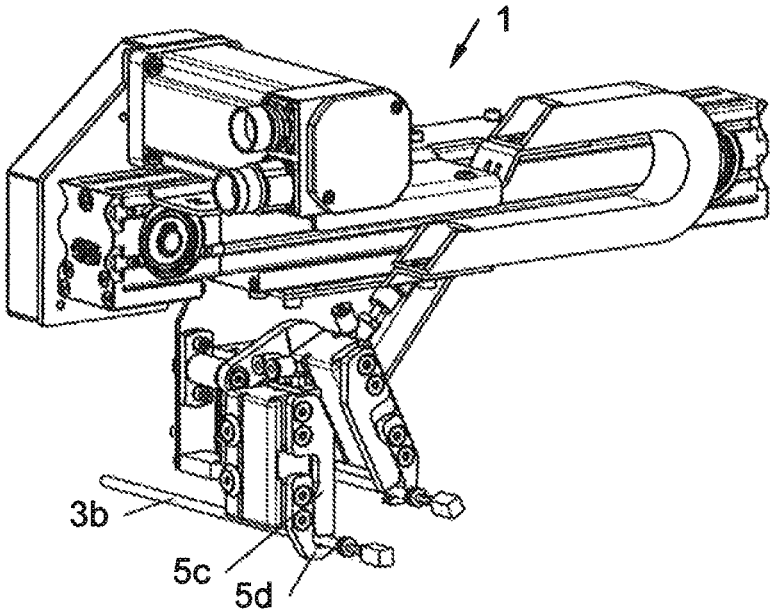
Figure 15:
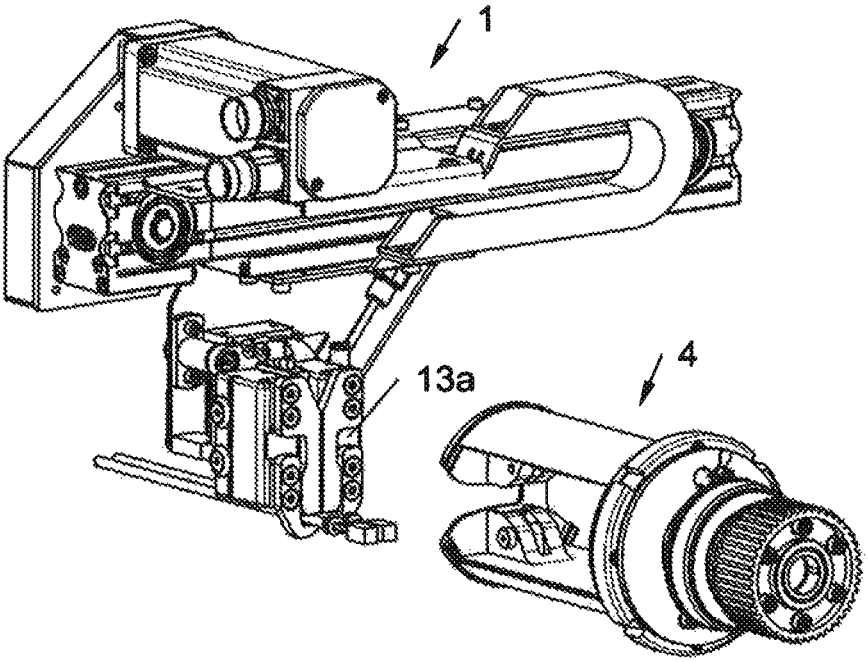
Figure 16:
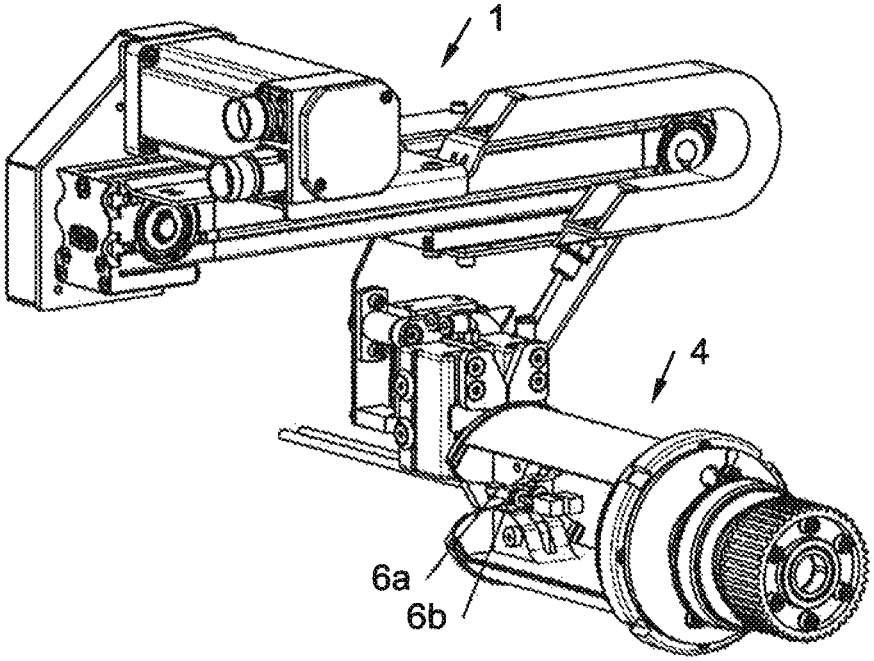
Figure 17:
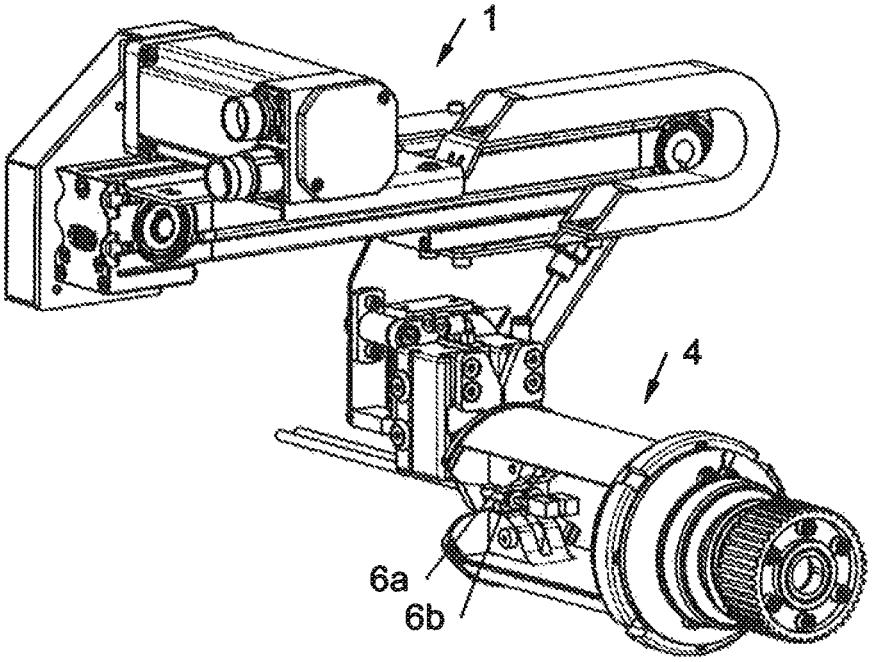

The appended reference symbol list is a component of the disclosure. The figures are described in a cohesive and comprehensive manner. The same reference symbols denote the same parts; reference symbols with different indices specify components with the same or similar functions. In the figures:

FIG. 1—depicts an example of a twist application device;

FIG. 2—depicts a first, exemplary and schematically represented form of embodiment of flat clamping jaws of a feed device;

FIG. 3—as FIG. 2, only with clamping jaws with teeth;

FIG. 4—as FIG. 2, only with depressions for the accommodation of conductors;

FIG. 5—a detailed view of first clamping jaws with clamped conductors at a small distance from one another;

FIG. 6—a detailed view of first clamping jaws with clamped conductors at a larger distance from one another;

FIG. 7—a detailed view of a twist application head with clamped conductors at a small distance from one another;

FIG. 8—a detailed view of a twist application head with clamped conductors at a larger distance from one another;

FIG. 9—the feed device from FIG. 1 in a standby position;

FIG. 10—the feed device with the first linear gripper in position;

FIG. 11—as FIG. 10, only with a first conductor captured;

FIG. 12—the feed device with the first linear gripper pivoted out of position;

FIG. 13—the feed device with the second linear gripper in position;

FIG. 14—as FIG. 13, only with a second conductor captured;

FIG. 15—the feed device with linear grippers adjusted in accordance with a selected conductor separation;

FIG. 16—the feed device in a position for transfer to the twist application head;

FIG. 17—as FIG. 16, only with the second clamping jaws of the twist application head activated, or to be understood as FIG. 16, only with the second clamping jaws of the twist application head activated.

Figure 18:
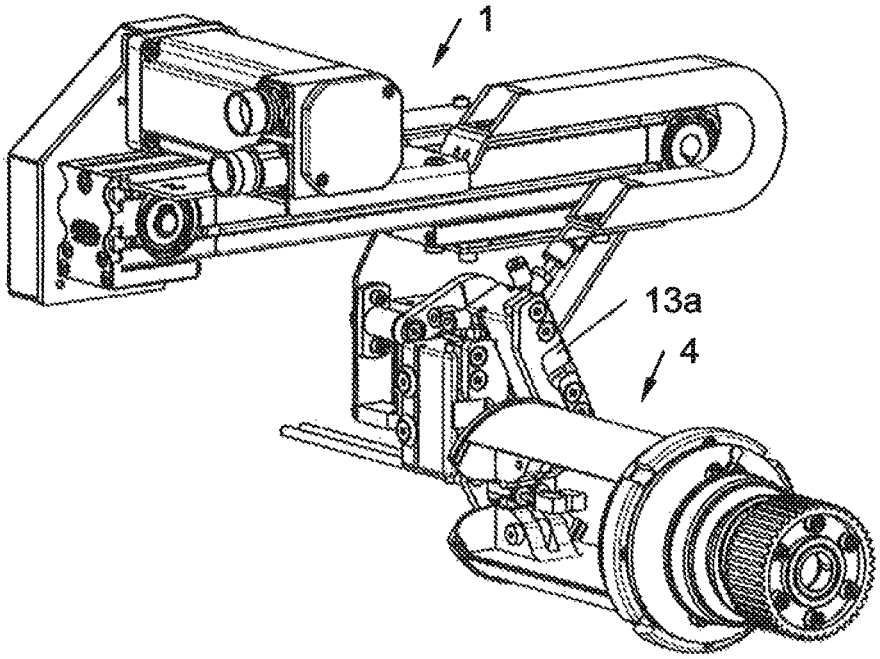
Figure 19:
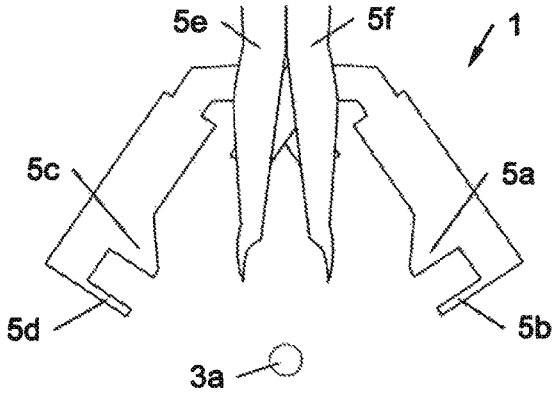
Figure 21:
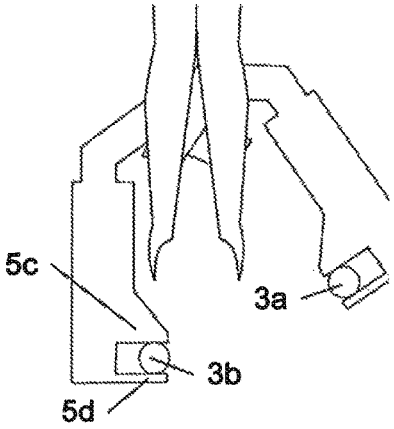
Figure 20:
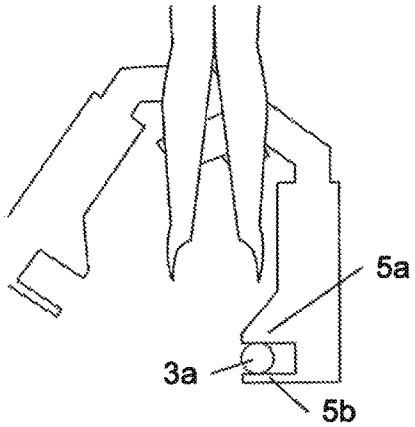
Figure 22:
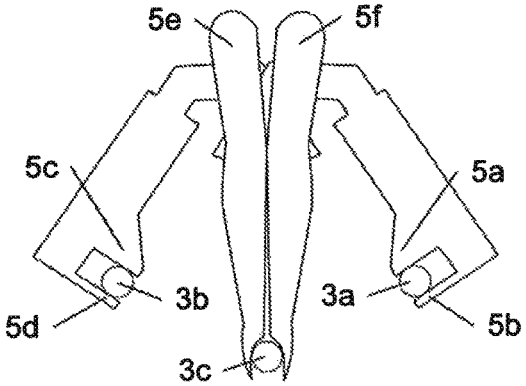
Figure 23:
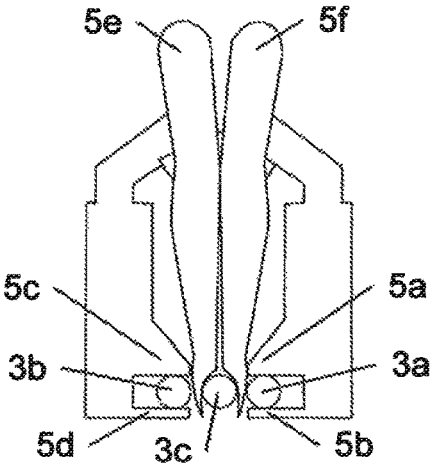
Figure 25:
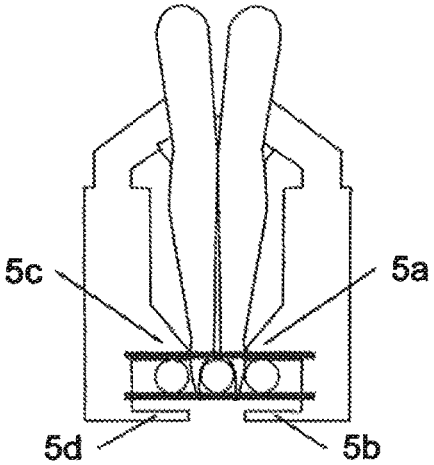
Figure 24:
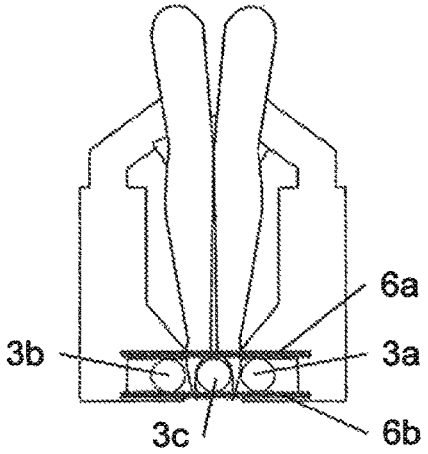
Figure 26:
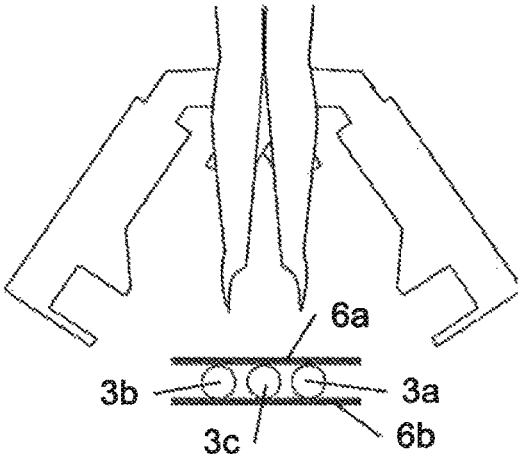

FIG. 18—as FIG. 17, only with the first clamping jaws of the feed device released;

FIG. 19—shows a schematic representation of three grippers with first clamping jaws in a standby position;

FIG. 20—shows the arrangement from FIG. 19, with a first conductor that has been captured by the first gripper;

FIG. 21—shows the arrangement from FIG. 19, with the first gripper pivoted out of position, and a second conductor that has been captured by the second gripper;

FIG. 22—shows the arrangement from FIG. 19, with the first and second grippers pivoted out of position, and a third conductor that has been captured by the third gripper;

FIG. 23—the arrangement from FIG. 19, with grippers adjusted in accordance with a selected conductor separation;

FIG. 24—as FIG. 23, only with the second clamping jaws of the twist application head, which have captured the three conductors;

FIG. 25—as FIG. 24, only with the first clamping jaws released, and,

FIG. 26—as FIG. 25, only with the grippers pivoted out of position.

In the present text, numerous specific details are set forth in order to provide a thorough understanding of versions of the present invention. It will be apparent, however, to one skilled in the art, that some versions of the present invention may possibly be practiced without some of these specific details. Indeed, reference in this specification to "a variant," "variants," and "one/the variant," or "one embodiment," "an embodiment" and the like, should be understood to mean that a particular feature, structure, or characteristic described in connection with the variant or embodiment is included in at least one such variant or embodiment according to the disclosure. Thus, the appearances of phrases such as "in one variant," "in one embodiment," and the like, in various places in the specification are not necessarily all referring to the same version or embodiment, nor are separate or alternative variants or embodiments mutually exclusive of other embodiments or variants. Moreover, various features may be described which possibly may be exhibited by some variants or embodiments and not by others. Similarly, various requirements are described which may be requirements for some variants or embodiments, but not others. Furthermore, as used throughout this specification, the terms 'a', 'an', 'at least' do not denote a limitation of quantity, but rather denote the presence of at least one of the referenced item, in the sense that singular reference of an element does not necessarily exclude the plural reference of such elements. Concurrently, the term "a plurality" denotes the presence of more than one referenced items. Finally, the terms "connected" or "coupled" and related terms are used in an operational sense and are not necessarily limited to a direct connection or coupling.

FIG. 1 depicts an exemplary twist application device, which includes a feeder or feed device 1 for feeding conductor ends 2*a*, 2*b* of two conductors 3*a*, 3*b*, and a twist application head 4 mounted such that it may rotate for twisting the said conductors 3*a*, 3*b*. The feed device 1 has first clamping jaws 5*a* . . . 5*d*, and the twist application head 4 has second clamping jaws 6*a*, 6*b* for clamping the conductor ends 2*a*, 2*b*. (Note: in FIG. 1 the clamping jaw 5*b* is covered by the conductor 3*a*, and is therefore not visible). The feed device 1 and the twist application head 4 may be moved relative to one another into a transfer position, in which the first clamping jaws 5*a* . . . 5*d* and the second clamping jaws 6*a*, 6*b* are located opposite one another, so that the conductor ends 2*a*, 2*b* may be transferred from the feed device 1 into the twist application head 4. With the aid of the twist application head 4, the conductors 3*a*, 3*b* are then twisted in a manner known per se, in order, for example, thus to manufacture a twisted-pair conductor.

The first clamping jaws 5*a* . . . 5*d* in a clamping position may be moved relative to one another such that a distance between clamped conductor ends 2*a*, 2*b* may be altered. For this purpose the twist application device has a controller 7 that is connected with a drive 8 for the first clamping jaws 5*a* . . . 5*d* and is equipped for the control of the latter, such that the distance between clamped conductor ends 2*a*, 2*b* is set at an adjustable value before the transfer into the twist application head 4. How the adjustment of the distance functions in practice shall be explained later in detail.

FIG. 2 depicts a schematic front view of the first clamping jaws 5*a*, 5*b*, from which it may be discerned that the first clamping jaws 5*a*, 5*b*, have clamping surfaces 9*a*, 9*b* facing towards one another, that are flat. FIG. 2 depicts the clamping jaws 5*a*, 5*b* in the fully-open position. From FIG. 2 it may furthermore be discerned that the width b of the intermediate space located between the fully-open first clamping jaws 5*a*, 5*b* is greater than its height h. Here, the width b is measured in a direction of movement A for purposes of altering the position of the conductor end 2*a*, while the height h is measured in a clamping direction B for purposes of clamping the conductor end 2*a*. In an advantageous variant, the width b is at least twice as large as the height h. In other words, an intermediate space located between the first clamping jaws 5*a*, 5*b* when the latter are fully-open extends, in a direction of movement A for purposes of altering the distance of the clamped conductor end 2*a*, at least twice as far as in a clamping direction B of the first clamping jaws 5*a*, 5*b* for purposes of clamping the conductor end 2*a*. By the proposed measures the conductor 3*a*, or rather the conductor end 2*a*, may be clamped in any position between the first clamping jaws 5*a*, 5*b*.

In a further alternative form, the width b is at least twice as large as the diameter d of the conductor 3*a*, or rather the conductor end 2*a*. In other words, an intermediate space located between the fully open first clamping jaws 5*a*, 5*b*, in a direction of movement A for purposes of altering the distance of the clamped conductor end 2*a* is at least twice as large as the diameter d of the conductor 3*a*, that is to say, the conductor end 2*a*, for which the feed device 1 is specified.

In another advantageous form, the width b is at least 9 mm. In other words, the intermediate space, located between the fully-open first clamping jaws 5*a*, 5*b*, is at least 9 mm in size in a direction of movement A for purposes of altering the position of the clamped conductor end 2*a*.

FIG. 3 depicts a form of embodiment in which the clamping surfaces 9*a*, 9*b* have teeth. Advantageously the height z of the teeth is less than 3% of the height h, or less than 10% of the diameter d, as a result of which the clamping surfaces 9*a*, 9*b* remain essentially flat and the conductor 3*a*, or rather the conductor end 2*a*, may be clamped at any position between the clamps 5*a*, 5*b*. However, by virtue of the teeth the clamping action is more effective than in the form of embodiment represented in FIG. 2.

An exemplary twist application device embodied in specific form is specified for the twisting of cables 3*a*, 3*b* with a cross-section from 0.35 $mm^2$ up to 2.5 $mm^2$, but cables with a diameter of up to 3 mm and a cross-section of 7.1 $mm^2$ can be processed. Here, the clamping jaws have a width b of 9 mm, as a result of which the centre-to-centre distance between the conductors 3*a*, 3*b* is a maximum of 15 mm (compare also the distance a in FIGS. 5 and 6). The height of the teeth is 0.2 mm. While these values are indeed advantageous, they are not mandatory. Should the twist application device be able to process larger cables 3*a*, 3*b*, the dimensions may be increased correspondingly.

FIG. 4 depicts a variant in which the clamping surfaces 9*a*, 9*b* in each case have four half-shell shaped grooves for accommodating the conductor 3*a*, or rather the conductor end 2*a*. Here the depth t of a groove is slightly less than half the diameter d of the conductor 3*a*, or rather the conductor end 2*a*. The conductor 3*a*, or rather the conductor end 2*a*, may thus be clamped in any one of the positions prescribed by the grooves between the clamps 5*a*, 5*b*. In general the clamping surfaces 9*a*, 9*b* may also have more or less than four half-shell shaped grooves. In particular, more than one, and in particular more than two, half-shell shaped grooves are to be provided.

FIGS. 5 and 6 depict how the distance between two conductors 3*a*, 3*b*, that is to say, between two conductor ends 2*a*, 2*b*, may be varied by varying the position in which the latter are clamped in the feed device 1. In each of the upper illustrations the clamping jaws 5*a* . . . 5*d* are represented with two clamped conductors 3*a*, 3*b*; while in each of the lower illustrations the twisted conductors 3*a*, 3*b* are represented.

In FIG. 5 the conductors 3*a*, 3*b* are clamped with a relatively small distance a between them, while in FIG. 6, the distance a between them is relatively large. Under the presupposition that these distances a must also be maintained during the twisting process, different lengths l of the non-twisted end sections ensue. To this end, FIG. 7 depicts clamping of the conductors 3*a*, 3*b*, corresponding to FIG. 5, between the two clamps 6*a*, 6*b* of the twist application head 4. Further, FIG. 8 depicts clamping of the conductors 3*a*, 3*b*, corresponding to FIG. 6, between the two clamps 6*a*, 6*b* of the twist application head 4. For purposes of rotating the twist application head 4, the latter has a gear 10, with which a drive pinion (not represented), or a drive belt engages. The non-twisted end section represented in FIG. 6 is now discernibly larger than the non-twisted end section represented in FIG. 5.

Thin conductors 3*a*, 3*b*, with small (crimped) contacts and small seals as necessary, may be arranged with a smaller distance a between them than conductors 3*a*, 3*b* with a large external diameter, in particular those that are fitted with large volume (crimped) contacts and seals. In this manner, the conductors 3*a*, 3*b* may be twisted along the greatest possible length.

The previous illustrations show examples in which the first clamping jaws 5*a* . . . 5*d* in a clamping position may be moved relative to one another such that a distance between clamped two conductor ends 3*a*, 3*b* may be altered, as a result of which twisted-pair conductors may in particular be manufactured with conductor ends 2*a*, 2*b* that are variously spaced apart.

However, this is not the only conceivable form of embodiment. It is also possible, for example, that the first clamping jaws 5*a* . . . 5*d* in a clamping position may be moved relative to one another such that a distance between three clamped conductor ends may be altered (see FIGS. 19 to 26). In this manner, three-wire twisted conductors may be manufactured with conductor ends that are variously spaced apart.

An exemplary method for purposes of twisting two conductors 3*a*, 3*b* with the aid of the feed device 1 and the twist application head 4 is now explained in more detail with the aid of FIGS. 9 to 18.

FIG. 9 depicts the feed device 1 from FIG. 1 in a first state in which the first conductor is already arranged in the vicinity of the first clamps 5*a*, 5*b*, but is not yet clamped. Moreover, further details are indicated in FIG. 9. A (crimped) contact 11*a*, is arranged on the conductor 3*a*, together with a seal 12*a*. Both project beyond the cross-section of the conductor 3*a*, and thus determine the smallest distance that can be achieved between a plurality of conductors 3*a*, 3*b*.

Furthermore, specifically indicated in FIG. 9 are the two linear grippers 13*a*, 13*b*, that have the clamping jaws 5*a* . . . 5*d*, a pneumatic ram 14, a horizontal guide 15, a carriage 16 mounted on the latter such that it may move, a pivot bearing 17, on which the first linear gripper 13 is mounted such that it may rotate, together with a vertical guide 18, with which the second linear gripper 13*b* is mounted such that it may move vertically. With the aid of the drive 8 the carriage 16, and thus the linear grippers 13*a*, 13*b* that are mounted on the latter, may be traversed horizontally along the horizontal guide 15. In addition, the first linear gripper 13*a* may be pivoted about the pivot bearing 17 with the aid of the pneumatic ram 14. Finally, the second linear gripper may be moved vertically along the vertical guide 18 by pneumatic means. Finally, the clamping jaws 5*b*, 5*d* may also be moved relative to the clamping jaws 5*a*, 5*c*. In general, needless to say, another form of drive, for example an electrical or hydraulic drive, may be provided instead of a pneumatic drive. In the first state illustrated in FIG. 9 the first linear gripper 13*a* is pivoted upwards, the second linear gripper 13*b* is moved upwards, and the clamping jaws 5*a* . . . 5*d* are open.

FIG. 10 depicts the feed device 1 in a second state, in which the first linear gripper 13*a* is pivoted downwards, the second linear gripper 13*b*, as before, is moved upwards, and the clamping jaws 5*a* . . . 5*d* are still open.

FIG. 11 depicts the feed device 1 in a further state, in which the clamping jaws 5*a*, 5*b* are closed and have clamped the conductor 3*a*. Before the clamping process takes place the first linear gripper 13*a* is positioned horizontally in accordance with a required position of the conductor 3*a* with the aid of the controller 7 and the drive 8.

FIG. 12 depicts the feed device 1 in a further state, in which the first linear gripper 13*a*, together with the clamped conductor 3*a*, is pivoted upwards, the second linear gripper 13*b* is moved downwards, and the clamping jaws 5*c*, 5*d* are still open. The conductor 3*b* is already arranged in the vicinity of the clamping jaws 5*c*, 5*d*.

FIG. 13 depicts the feed device 1 in a further state, in which the second linear gripper 13*b* has been positioned horizontally in accordance with a required position of the conductor 3*b* with the aid of the controller 7 and the drive 8.

FIG. 14 depicts the feed device 1 in a further state, in which the clamping jaws 5*c*, 5*d* have been closed, and have clamped the conductor 3*b*.

FIG. 15 depicts the feed device 1 and the twist application head 4 in a state in which the first linear gripper 13*a* is pivoted downwards, and the conductors 3*a*, 3*b* are arranged at a required distance from one another.

FIG. 16 depicts the feed device 1 and the twist application head 4 in a state in which the feed device 1 has been moved into a transfer position with the twist application head 4, in which the first clamping jaws 5*a* . . . 5*d* of the feed device 1 and the second clamping jaws 6*a*, 6*b* of the twist application head 4 are located opposite one another.

FIG. 17 depicts the feed device 1 and the twist application head 4 in a state in which the second clamping jaws 6*a*, 6*b* of the twist application head 4 have been closed, and are clamping the conductors 3*a*, 3*b*.

FIG. 18 depicts the feed device 1 and the twist application head 4 in a state in which the first clamping jaws 5*a* . . . 5*d* of the feed device 1 are open, and the conductors 3*a*, 3*b* have accordingly been transferred to the twist application head 4. Here the first linear gripper 13*a* has already been pivoted upwards, so that the feed device 1 may be moved out of the vicinity of the twist application head 4. By fixing the other conductor ends (not represented) and rotating the twist application head 4 the conductors 3*a*, 3*b* can then be twisted in a manner known per se.

A method for twisting the two conductors 3*a*, 3*b* with the aid of the feed device 1 with first clamping jaws 5*a* . . . 5*d* and the twist application device 1 with the twist application head 4 with second clamping jaws 6*a*, 6*b* thus includes the following steps:

Clamping of the conductor ends 2*a*, 2*b* of the said conductors 3*a*, 3*b* between the first clamping jaws 5*a* . . . 5*d* of the feed device 1, Movement of the feed device 1 into a transfer position with the twist application head 4, in which the first clamping jaws 5*a* . . . 5*d* of the feed device 1 and the second clamping jaws 6*a*, 6*b* of the twist application head 4 are located opposite one another, Clamping of the conductor ends 2*a*, 2*b* between the second clamping jaws 6*a*, 6*b* of the twist application head 4, Release of the first clamping jaws 5*a* . . . 5*d* of the feed device 1, and, Twisting of the conductors 3*a*, 3*b* by rotation of the twist application head 4.

The distance between clamped conductor ends 2*a*, 2*b* is thereby set at an adjustable value by movement of the first clamping jaws 5*a* . . . 5*d* into a clamping position before the clamping of the conductor ends 2*a*, 2*b* in the second clamping jaws 6*a*, 6*b* of the twist application head 4. In particular, at least two different values may be selected for the distance between the clamped conductor ends 2*a*, 2*b*.

In the example depicted, the conductor ends 2*a*, 2*b* are captured and clamped by the feed device 1 individually and in sequence, and are captured and clamped by the twist application head 4 jointly and simultaneously. However, it is also conceivable for the conductor ends 2*a*, 2*b* also to be captured and clamped by the feed device 1 jointly and simultaneously.

Furthermore, a variable position of the first clamping jaws 5*a* . . . 5*d* is set in accordance with a selected distance a between the conductor ends 2*a*, 2*b* before the conductor ends 2*a*, 2*b* are clamped, and the first clamping jaws 5*a* . . . 5*d* are moved into a fixed prescribed position before the clamping of the conductor ends 2*a*, 2*b* in the second clamping jaws 6*a*, 6*b* of the twist application head 4 (on this point see, in particular, FIGS. 2 to 6, together with the horizontal guide 15, with which the linear grippers 13*a*, 13*b* may be traversed horizontally). In concrete terms, the distance a aimed for in the twist application head 4 is already defined during the clamping process by the feed device 1, in that when capturing the conductors 2*a*, 2*b*, the linear grippers 13*a*, 13*b* are traversed into an appropriate (variable) position (see in particular FIG. 10 and FIG. 13). In contrast, the positioning of the linear grippers 13*a*, 13*b* during the transfer to the twist application head 4 is fixed. That is to say, for the transfer of the conductors 2*a*, 2*b* to the twist application head the linear grippers 13*a*, 13*b* are always traversed to the same position.

It should be understood that this is not the only conceivable option. It is also conceivable, for example, that the first clamping jaws 5*a* . . . 5*d* are moved into a fixed prescribed position before the clamping of the conductor ends 2*a*, 2*b*, and a variable position of the first clamping jaws 5*a* . . . 5*d* is set in accordance with a selected distance a between the conductor ends 2*a*, 2*b* before the clamping of the conductor ends 2*a*, 2*b* in the second clamping jaws 6*a*, 6*b* of the twist application head 4. In concrete terms, this means that the linear grippers 13*a*, 13*b* in FIGS. 10 and 13 always traverse to the same position, but in the transfer of the conductors 2*a*, 2*b* to the twist application head 4 (see FIG. 16) are traversed to a position corresponding to the selected distance a.

Generally for purposes of clamping a conductor end 2*a*, 2*b* the first clamping jaws 5*a* . . . 5*d* may be mounted so that they may be moved relative to one another, and for purposes of altering the distance between clamped conductor ends 2*a*, 2*b* they may be mounted so that they may be rotated relative to one another without affecting a clamping position, as is represented in FIGS. 1 to 18. However, it is also conceivable for the first clamping jaws 5*a* . . . 5*d* to be mounted such that they may be moved relative to one another, both for purposes of clamping a conductor end 2*a*, 2*b*, and also for purposes of altering the distance between clamped conductor ends 2*a*, 2*b*. Likewise the first clamping jaws 5*a* . . . 5*d* may be mounted such that they may be rotated relative to one another, both for purposes of clamping a conductor end 2*a*, 2*b*, and also for purposes of altering the distance between clamped conductor ends 2*a*, 2*b*. Finally, it is also possible that for purposes of clamping a conductor end 2*a*, 2*b* the first clamping jaws 5*a* . . . 5*d* are mounted such that they may be rotated relative to one another, and for purposes of altering the distance between clamped conductor ends 2*a*, 2*b* they are mounted such that they may moved be relative to one another without affecting a clamping position.

Furthermore, the second clamping jaws 6*a*, 6*b* may also be mounted such that they may be moved relative to one another for purposes of clamping a conductor end 2*a*, 2*b*, as represented in FIGS. 1 to 18, but are also mounted such that they can be rotated. Moreover, it is also conceivable for the second clamping jaws 6*a*, 6*b* to be designed as represented in FIGS. 2 to 4. That is to say, the second clamping jaws 6*a*, 6*b* may have clamping surfaces facing towards one another, which c) are essentially flat, or, d) comprise more than two, in particular more than three, half-shell shaped grooves for purposes of accommodating one conductor end 2*a*, 2*b* in each case.

FIGS. 19 to 26 now schematically depict an exemplary sequence for purposes of clamping (and twisting) three conductors 3*a* . . . 3*c*.

In FIG. 19 the first clamping jaws 5*a* . . . 5*f* are located in an initial position for this purpose, and a first conductor 3*a* is located in the vicinity of the feed device 1.

FIG. 20 depicts the arrangement in a state in which the clamping jaws 5*a*, 5*b* have been traversed onto the first conductor 3*a*, and have captured, that is to say, clamped the latter.

FIG. 21 depicts the arrangement in a state in which the clamping jaws 5*c*, 5*d* have been traversed onto a second conductor 3*b*, brought into the vicinity of the feed device 1, and have captured, that is to say, clamped the latter. In the meantime the clamping jaws 5*a*, 5*b*, together with the clamped first conductor 3*a*, have been moved out of the vicinity of the conductor 3*b*.

FIG. 22 depicts the arrangement in a state in which the clamping jaws 5*e*, 5*f* have been traversed onto a third conductor 3*c*, brought into the vicinity of the feed device 1, and have captured, that is to say, clamped the latter. In the meantime the clamping jaws 5*c*, 5*d*, together with the clamped second conductor 3*b*, have been moved out of the vicinity of the conductor 3*c*.

The clamping jaws 5*a* . . . 5*f* are then traversed towards one another into a position in which they transfer the conductors 3*a* . . . 3*c* to the twist application head 4. This state is represented in FIG. 23.

In FIG. 24 the conductors 3*a* . . . 3*c* have been captured, that is to say, clamped by the second clamping jaws 6*a*, 6*b* of the twist application head 4. However, as before the conductors 3*a* . . . 3*c* also continue to be held by the clamping jaws 5*a* . . . 5*f* of the feed device 1. In FIG. 25, in contrast, the clamping jaws 5*a* . . . 5*d* have already been released.

Finally, FIG. 26 depicts a state in which the clamping jaws 5*a* . . . 5*f* have been moved out of the vicinity of the conductors 3*a* . . . 3*c*, clamped in the twist application head 4. The conductors 3*a* . . . 3*c* may thus be twisted in a manner known per se.

At this point, it should be noted that the variants disclosed in FIGS. 1 to 18 may also be applied in an analogous manner to the variants disclosed in FIGS. 19 to 26. In particular, this relates to the form and mounting of the first clamping jaws 5*a* . . . 5*f* and the second clamping jaws 6*a*, 6*b*.

Further Aspects

In further aspect, the present disclosure includes FIG. 1 that depicts an exemplary twist application device, that includes a feed device 1 for feeding conductor ends 2*a*, 2*b* of two conductors 3*a*, 3*b*, and a twist application head 4, mounted such that it may rotate for twisting the conductors 3*a*, 3*b*. In this example, the twist application head 4 thus forms the further-processing device. The feed device 1 has first clamping jaws 5*a* . . . 5*d*, and the drilling head 4 has second clamping jaws 6*a*, 6*b* for clamping the line ends 2*a*, 2*b*. (Note: in FIG. 1 the clamping jaw 5*b* is covered by the conductor 3*a*, and is therefore not visible). The feed device 1 and the twist application head 4 may be moved relative to one another into a transfer position, in which the first clamping jaws 5*a* . . . 5*d* and the second clamping jaws are located opposite one another, so that the conductor ends 2*a*, 2*b* may be transferred from the feed device 1 into the twist application head 4. With the aid of the twist application head 4, the conductors 3*a*, 3*b* are then twisted in a manner known per se, in order, for example, thus to manufacture a twisted-pair conductor.

The first clamping jaws 5*a* . . . 5*d* in a clamping position may be moved relative to one another such that a distance between clamped conductor ends 2*a*, 2*b* may be altered. For this purpose, the twist application device has a controller 7, that is connected with a drive 8 for the first clamping jaws 5*a* . . . 5*d* and is equipped for the control of the latter, such that the distance between clamped conductor ends 2*a*, 2*b* is set at an adjustable value before the transfer into the twist application head 4. How the adjustment of the distance functions in practice shall be explained subsequently in detail.

FIG. 2 depicts a schematic front view of the first clamping jaws 5*a*, 5*b*, from which it can be discerned that the first clamping jaws 5*a*, 5*b*, have clamping surfaces 9*a*, 9*b* facing towards one another, that are flat. FIG. 2 shows the clamping jaws 5*a*, 5*b* in the fully-open position. From FIG. 2 it can furthermore be discerned that the width b of the intermediate space located between the fully open first clamping jaws 5*a*, 5*b* is greater than its height h. Here, the width b is measured in a direction of movement A for purposes of altering the position of the conductor end 2*a*, while the height h is measured in a clamping direction B for purposes of clamping the conductor end 2*a*. In an advantageous variant of embodiment, the width b is at least twice as large as the height h. In other words, an intermediate space located between the first clamping jaws 5*a*, 5*b* when the latter are fully-open extends, in a direction of movement A for purposes of altering the distance of the clamped conductor end 2*a*, at least twice as far as in a clamping direction B of the first clamping jaws 5*a*, 5*b* for purposes of clamping the conductor end 2*a*. By the proposed measures, the conductor 3*a*, or rather the conductor end 2*a*, may be clamped in any position between the first clamping jaws 5*a*, 5*b*.

In a further alternative form of embodiment the width b is at least twice as large as the diameter d of the conductor 3*a*, or rather the conductor end 2*a*. In other words, an intermediate space located between the fully-open first clamping jaws 5*a*, 5*b*, in a direction of movement A for purposes of altering the distance of the clamped conductor end 2*a* is at least twice as large as the diameter d of the conductor 3*a*, that is to say, the conductor end 2*a*, for which the feed device 1 is specified.

In another advantageous form of embodiment the width b is at least 9 mm. In other words, the intermediate space, located between the fully-open first clamping jaws 5*a*, 5*b*, is at least 9 mm in size in a direction of movement A for purposes of altering the position of the clamped conductor end 2*a*.

FIG. 3 now depicts a form of embodiment in which the clamping surfaces 9*a*, 9*b* have teeth. Advantageously, the height z of the teeth is less than 3% of the height h, or less than 10% of the diameter d, as a result of which the clamping surfaces 9*a*, 9*b* remain essentially flat. and the conductor 3*a*, or rather the conductor end 2*a*, may be clamped at any position between the clamps 5*a*, 5*b*. However, by virtue of the teeth the clamping action is more effective than in the form of embodiment represented in FIG. 2.

An exemplary twist application device embodied in specific form is specified for the twisting of cables 3*a*, 3*b* with a cross-section from 0.35 $mm^2$ up to 2.5 $mm^2$, but cables with a diameter of up to 3 mm and a cross-section of 7.1 $mm^2$ can be processed. Here, the clamping jaws have a width b of 9 mm, as a result of which the centre-to-centre distance between the conductors 3*a*, 3*b* is a maximum of 15 mm (compare also the distance a in FIGS. 5 and 6). The height of the teeth is 0.2 mm. While these values may indeed be advantageous, they are not mandatory. Should the twist application device be able to process larger cables 3*a*, 3*b*, the dimensions may be increased correspondingly.

FIG. 4 now depicts a variant of embodiment in which the clamping surfaces 9*a*, 9*b* in each case have four half-shell shaped grooves for purposes of accommodating the conductor 3*a*, or rather the conductor end 2*a*. Here the depth t of a groove is slightly less than half the diameter d of the conductor 3*a*, or rather the conductor end 2*a*. The conductor 3*a*, or rather the conductor end 2*a*, may thus be clamped in any one of the positions prescribed by the grooves between the clamps 5*a*, 5*b*. In general the clamping surfaces 9*a*, 9*b* may also have more or less than four half-shell shaped grooves. In particular more than one, in particular more than two, half-shell shaped grooves are to be provided.

FIGS. 5 and 6 now depict how the distance between two conductors 3*a*, 3*b*, that is to say, between two conductor ends 2*a*, 2*b*, may be varied by varying the position in which the latter are clamped in the feed device 1. In each of the upper illustrations the clamping jaws 5*a* . . . 5*d* are represented with two clamped conductors 3*a*, 3*b*, while in each of the lower illustrations the twisted conductors 3*a*, 3*b* are represented.

In FIG. 5 the conductors 3*a*, 3*b* are clamped with a relatively small distance a between them, while in FIG. 6 the distance a between them is relatively large. Under the presupposition that these distances a must also be maintained during the twisting process, different lengths l of the non-twisted end sections ensue. To this end, FIG. 7 shows clamping of the conductors 3*a*, 3*b*, corresponding to FIG. 5, between the two clamps 6*a*, 6*b* of the twisting head 4, while FIG. 8 shows clamping of the conductors 3*a*, 3*b*, corresponding to FIG. 6, between the two clamps 6*a*, 6*b* of the twisting head 4. For purposes of rotating the twist application head 4 the latter has a gear 10, with which a drive pinion (not represented), or a drive belt engages. The non-twisted end section represented in FIG. 6 is now discernibly larger than the non-twisted end section represented in FIG. 5.

Thin conductors 3*a*, 3*b*, with small (crimped) contacts and small seals as necessary, may be arranged with a smaller distance a between them than conductors 3*a*, 3*b* with a large external diameter, in particular those that are fitted with large volume (crimped) contacts and seals. In this manner, the conductors 3*a*, 3*b* may be twisted along the greatest possible length.

The previous illustrations show examples in which the first clamping jaws 5*a* . . . 5*d* in a clamping position may be moved relative to one another such that a distance between clamped two conductor ends 3*a*, 3*b* may be altered, as a result of which twisted-pair conductors may in particular be manufactured with conductor ends 2*a*, 2*b* that are variously spaced apart.

However, this is not the only conceivable form of embodiment. It is also possible, for example, that the first clamping jaws 5*a* . . . 5*d* in a clamping position may be moved relative to one another such that a distance between three clamped conductor ends can be altered (see FIGS. 19 to 26). In this manner three-wire twisted conductors may be manufactured with conductor ends that are variously spaced apart.

A method for purposes of twisting two conductors 3*a*, 3*b* with the aid of the feed device 1 and the twist application head 4 is now explained in more detail with the aid of FIGS. 9 to 18.

FIG. 9 shows the feed device 1 from FIG. 1 in a first state in which the first conductor 3*a* is already arranged in the region of the first clamps 5*a*, 5*b*, but is not yet clamped. Moreover, further details are indicated in FIG. 9. A (crimped) contact 11*a*, is arranged on the conductor 3*a*, together with a seal 12*a*. Both project beyond the cross-section of the conductor 3*a*, and thus determine the smallest distance that can be achieved between a plurality of conductors 3*a*, 3*b*.

Furthermore, specifically indicated in FIG. 9 are the two linear grippers 13*a*, 13*b*, which have the clamping jaws 5*a* . . . 5*d*, a pneumatic ram 14, a horizontal guide 15, a carriage 16 mounted on the latter such that it can move, a pivot bearing 17, on which the first linear gripper 13 is mounted such that it can rotate, together with a vertical guide 18, with which the second linear gripper 13*b* is mounted such that it can move vertically. With the aid of the drive 8, the carriage 16, and thus the linear grippers 13*a*, 13*b* that are mounted on the latter, may be traversed horizontally along the horizontal guide 15. In addition, the first linear gripper 13*a* may be pivoted about the pivot bearing 17 with the aid of the pneumatic ram 14. Finally, the second linear gripper may be moved vertically along the vertical guide 18 by pneumatic means. Finally, the clamping jaws 5*b*, 5*d* may also be moved relative to the clamping jaws 5*a*, 5*c*. In general, needless to say, another form of drive, for example an electrical or hydraulic drive, may be provided instead of a pneumatic drive. In the first state illustrated in FIG. 9, the first linear gripper 13*a* is pivoted upwards, the second linear gripper 13*b* is moved upwards, and the clamping jaws 5*a* . . . 5*d* are open.

FIG. 10 depicts the feed device 1 in a second state, in which the first linear gripper 13*a* is pivoted downwards, the second linear gripper 13*b*, as before, is moved upwards, and the clamping jaws 5*a* . . . 5*d* are still open.

FIG. 11 shows the feed device 1 in a further state, in which the clamping jaws 5*a*, 5*b* are closed and have clamped the conductor 3*a*. Before the clamping process takes place, the first linear gripper 13*a* is positioned horizontally in accordance with a required position of the conductor 3*a* with the aid of the controller 7 and the drive 8.

FIG. 12 depicts the feed device 1 in a further state, in which the first linear gripper 13*a*, together with the clamped conductor 3*a*, is pivoted upwards, the second linear gripper

13*b* is moved downwards, and the clamping jaws 5*c*, 5*d* are still open. The conductor 3*b* is already arranged in the region of the clamping jaws 5*c*, 5*d*.

FIG. 13 shows the feed device 1 in a further state, in which the second linear gripper 13*b* has been positioned horizontally in accordance with a required position of the conductor 3*b* with the aid of the controller 7 and the drive 8.

FIG. 14 shows the feed device 1 in a further state, in which the clamping jaws 5*c*, 5*d* have been closed, and have clamped the conductor 3*b*.

FIG. 15 shows the feed device 1 and the twist application head 4 in a state in which the first linear gripper 13*a* is pivoted downwards, and the conductors 3*a*, 3*b* are arranged at a required distance from one another.

FIG. 16 shows the feed device 1 and the twist application head 4 in a state in which the feed device 1 has been moved into a transfer position with the twist application head 4, in which the first clamping jaws 5*a* . . . 5*d* of the feed device 1 and the second clamping jaws 6*a*, 6*b* of the twist application head 4 are located opposite one another.

FIG. 17 shows the feed device 1 and the twist application head 4 in a state in which the second clamping jaws 6*a*, 6*b* of the twist application head 4 have been closed, and are clamping the conductors 3*a*, 3*b*.

FIG. 18 shows the feed device 1 and the twist application head 4 in a state in which the first clamping jaws 5*a* . . . 5*d* of the feed device 1 are open, and the conductors 3*a*, 3*b* have accordingly been transferred to the twist application head 4. Here, the first linear gripper 13*a* has already been pivoted upwards, so that the feed device 1 may be moved out of the region of the twist application head 4. By fixing the other conductor ends (not represented) and rotating the twist application head 4, the conductors 3*a*, 3*b* may then be twisted in a manner known per se.

The method of twisting the two conductors 3*a*, 3*b* with the aid of the feed device 1 with first clamping jaws 5*a* . . . 5*d* and the twist application device 1 with the twist application head 4 with second clamping jaws 6*a*, 6*b* thus includes the following steps:

- Clamping of the conductor ends 2*a*, 2*b* of the conductors 3*a*, 3*b* between the first clamping jaws 5*a* . . . 5*d* of the feed device 1;
- Movement of the feed device 1 into a transfer position with the twist application head 4, in which the first clamping jaws 5*a* . . . 5*d* of the feed device 1 and the second clamping jaws 6*a*, 6*b* of the twist application head 4 are located opposite one another;
- Clamping of the conductor ends 2*a*, 2*b* between the second clamping jaws 6*a*, 6*b* of the twist application head 4;
- Release of the first clamping jaws 5*a* . . . 5*d* of the feed device 1 and twisting of the said conductors 3*a*, 3*b* by rotation of the twist application head 4.

The distance between clamped conductor ends 2*a*, 2*b* is thereby set at an adjustable value by movement of the first clamping jaws 5*a* . . . 5*d* into a clamping position before the clamping of the conductor ends 2*a*, 2*b* in the second clamping jaws 6*a*, 6*b* of the twist application head 4. In particular, at least two different values may be selected for the distance between the clamped conductor ends 2*a*, 2*b*.

In the example depicted, the conductor ends 2*a*, 2*b* are captured and clamped by the feed device 1 individually and in sequence, and are captured and clamped by the twist application head 4 jointly and simultaneously. However, it is also conceivable for the conductor ends 2*a*, 2*b* also to be captured and clamped by the feed device 1 jointly and simultaneously.

Furthermore a variable position of the first clamping jaws 5*a* . . . 5*d* is set in accordance with a selected distance a between the conductor ends 2*a*, 2*b* before the conductor ends 2*a*, 2*b* are clamped, and the first clamping jaws 5*a* . . . 5*d* are moved into a fixed prescribed position before the clamping of the conductor ends 2*a*, 2*b* in the second clamping jaws 6*a*, 6*b* of the twist application head 4 (on this point see, in particular, FIGS. 2 to 6, together with the horizontal guide 15, with which the linear grippers 13*a*, 13*b* may be traversed horizontally). In concrete terms the distance a aimed for in the twist application head 4 is already defined during the clamping process by the feed device 1, in that when capturing the conductors 2*a*, 2*b* the linear grippers 13*a*, 13*b* are traversed into an appropriate (variable) position (see in particular FIG. 10 and FIG. 13). In contrast the positioning of the linear grippers 13*a*, 13*b* during the transfer to the twist application head 4 is fixed. That is to say, for the transfer of the conductors 2*a*, 2*b* to the twist application head, the linear grippers 13*a*, 13*b* are always traversed to the same position.

Generally, for clamping a conductor end 2*a*, 2*b* the first clamping jaws 5*a* . . . 5*d* may be mounted such that they can be moved relative to one another, and for purposes of altering the distance between clamped conductor ends 2*a*, 2*b* they may be mounted such that they can be rotated relative to one another without affecting a clamping position, as is represented in FIGS. 1 to 18. However, it is also conceivable for the first clamping jaws 5*a* . . . 5*d* to be mounted such that they may be moved relative to one another, both for purposes of clamping a conductor end 2*a*, 2*b*, and also for purposes of altering the distance between clamped conductor ends 2*a*, 2*b*. Likewise the first clamping jaws 5*a* . . . 5*d* may be mounted such that they can be rotated relative to one another, both for purposes of clamping a conductor end 2*a*, 2*b*, and also for purposes of altering the distance between clamped conductor ends 2*a*, 2*b*. Finally, it is also possible that for purposes of clamping a conductor end 2*a*, 2*b* the first clamping jaws 5*a* . . . 5*d* may be mounted such that they can be rotated relative to one another, and for purposes of altering the distance between clamped conductor ends 2*a*, 2*b* they may be mounted such that they may be moved relative to one another without affecting a clamping position.

Furthermore, the second clamping jaws 6*a*, 6*b* may also be mounted such that they may be moved relative to one another for purposes of clamping a conductor end 2*a*, 2*b*, as represented in FIGS. 1 to 18, but are also mounted such that they can be rotated. Moreover it is also conceivable for the second clamping jaws 6*a*, 6*b* to be designed as represented in FIGS. 2 to 4. That is to say, the second clamping jaws 6*a*, 6*b* may have clamping surfaces facing towards one another, that c) are essentially flat; or, d) include more than two, in particular more than three, half-shell shaped grooves for purposes of accommodating one conductor end 2*a*, 2*b* in each case.

FIGS. 19 to 26 now show schematically an exemplary sequence for purposes of clamping (and twisting) three conductors 3*a* . . . 3*c*.

In FIG. 19, the first clamping jaws 5*a* . . . 5*f* are located in an initial position for this purpose, and a first conductor 3*a* is located in the vicinity of the feed device 1.

FIG. 20 depicts the arrangement in a state in which the clamping jaws 5*a*, 5*b* have been traversed onto the first conductor 3*a*, and have captured, that is to say, clamped the latter.

FIG. 21 depicts the arrangement in a state in which the clamping jaws 5*c*, 5*d* have been traversed onto a second conductor 3*b*, brought into the vicinity of the feed device 1, and have captured, that is to say, clamped the latter. In the meantime the clamping jaws 5*a*, 5*b*, together with the clamped first conductor 3*a*, have been moved out of the vicinity of the conductor 3*b*.

FIG. 22 shows the arrangement in a state in which the clamping jaws 5*e*, 5*f* have been traversed onto a third conductor 3*c*, brought into the vicinity of the feed device 1, and have captured, that is to say, clamped the latter. In the meantime the clamping jaws 5*c*, 5*d*, together with the clamped second conductor 3*b*, have been moved out of the vicinity of the conductor 3*c*.

The clamping jaws 5*a* . . . 5*f* are then traversed towards one another into a position in which they transfer the conductors 3*a* . . . 3*c* to the twist application head 4. This state is represented in FIG. 23.

In FIG. 24 the conductors 3*a* . . . 3*c* have been captured, that is to say, clamped by the second clamping jaws 6*a*, 6*b* of the twist application head 4. However, as before the conductors 3*a* . . . 3*c* also continue to be held by the clamping jaws 5*a* . . . 5*f* of the feed device 1. In FIG. 25, in contrast, the clamping jaws 5*a* . . . 5*d* have already been released.

FIG. 26 shows finally a state in which the clamping jaws 5*a* . . . 5*f* have been moved out of the vicinity of the conductors 3*a* . . . 3*c*, clamped in the twist application head 4. The conductors 3*a* . . . 3*c* can thus be twisted in a manner known per se.

As to this section of the present disclosure, at this point it should be noted that the variants of embodiment disclosed in FIGS. 1 to 18 may also be applied in an analogous manner to the variants of embodiment disclosed in FIGS. 19 to 26. In particular, this relates to the form and mounting of the first clamping jaws 5*a* . . . 5*f* and the second clamping jaws 6*a*, 6*b*.

Although the disclosed feed device 1 may advantageous in the context of the twisting of conductors 3*a* . . . 3*c*, and FIGS. 1 to 18 deal just with this application, the feed device 1 is in no respect bound to this particular application. On the contrary, other further-processing devices 4 may also be conceived. For example, the further-processing device 4 may be formed in terms of an automatic device for purposes of pushing seals 12*a* onto the conductor ends 2*a*, 2*b*, or also in terms of an automatic device for purposes of fitting a (crimped) contact 11*a* onto the conductor ends 2*a*, 2*b*. In general the problem also occurs here that the conductors 3*a* . . . 3*c*, depending upon the size of the seal 12*a* of the contact 11*a*, must be spaced apart in a variable manner, in particular, if a seal 12*a*, or a contact 11*a* accommodates a plurality of conductors 3*a* . . . 3*c* and the distance between the conductors a during the fitting of such a seal 12*a*, or such a contact 11*a*, must be adjusted correctly. The cited problem also presents itself, however, if a plurality of seals 12*a* and/or contacts 11*a* are to be fitted onto a plurality of conductors 3*a* . . . 3*c* at the same time. Needless to say, automatic devices are also conceivable, that may undertake a plurality of the tasks cited.

Finally, it is also noted that the arrangements represented may in practice also include more components than represented. Furthermore, it is noted that the above configurations and developments of the invention may be combined in any manner. It should be noted that the term "comprising" does not exclude other elements or features, and that use of the terms "a" or "an" does not necessarily exclude a plurality, in the sense that singular reference of an element does not exclude the plural reference of such elements. The verb 'comprise' and its conjugations do not exclude the presence of elements or steps other than those listed in any claim or the specification as a whole. The mere fact that certain measures are recited in mutually different dependent claims does not indicate that a combination of these measures cannot possibly be used to advantage. Furthermore, elements described in association with different versions may possibly be combined. It should also be noted that the above-mentioned examples and versions illustrate rather than limit the invention, and that those skilled in the art will be capable of designing alternative implementations without departing from the scope of the invention as defined by the appended claims. Thus, in closing, it should be noted that the protected scope of invention is not limited to the abovementioned versions and exemplary working examples. Further developments, modifications and combinations are also within the scope of the appended patent claims and are placed in the possession of the person skilled in the art from the present disclosure. As equivalent elements may be substituted for elements employed in claimed invention to obtain substantially the same results in substantially the same way, the scope of present invention is defined by the appended claims, including known equivalents and unforeseeable equivalents at the time of filing of this application. Accordingly, the techniques and structures described and illustrated previously herein should be understood to be illustrative and exemplary, and not necessarily limiting upon the scope.

LIST OF REFERENCE LABELS

1 Feed device
2*a*, 2*b* Conductor end
3*a* . . . 3*c* Conductor
4 Twist application head, or Further-processing device
5*a* . . . 5*f* First clamping jaws of the feed device 1
6*a*, 6*b* Second clamping jaws of the twist application head 4
7 Controller
8 Drive
9*a*, 9*b* Clamping surfaces
10 Gear
11*a* (Crimped) contact
12*a* Seal
13*a*, 13*b* Linear gripper
14 Pneumatic ram
15 Horizontal guide
16 Carriage
17 Pivot bearing of the first linear gripper 13*a*
18 Vertical guide of the second linear gripper 13*b*
A Direction of movement
B Clamping direction
a Distance between conductors
b Intermediate space width
d Conductor diameter
h Intermediate space height
l Non-twisted conductor length
t Depth of the groove
z Tooth height

What is claimed is:

1. A twist application device comprising:

a feed device configured to feed at least two conductors to another device, said feed device including at least two first clamping devices, each of the at least two first clamping devices comprises at least two first clamping jaws configured to clamp conductor ends of said at least two conductors, said at least two first clamping devices being movable relative to one another, in a clamping position, in a direction of movement that allows a distance between clamped conductor ends to be altered;

a twist application head configured to receive conductors from said feed device, said twist application head including second clamping jaws configured to clamp said conductor ends when said feed device and said twist application head are moved relative to one another into a transfer position in which the at least two first clamping devices and the second clamping jaws are located opposite one another to facilitate transfer of said conductor ends from said feed device to said twist application head;

a controller;

a drive coupled to the controller;

said controller being configured to communicate with said drive and said drive being connected to said at least two first clamping devices to control operation thereof, said controller and said drive being configured to control movement of said at least two first clamping jaws, including being configured to move said at least two first clamping devices relative to one another in said clamping position in said direction of movement so as to alter said distance between clamped conductor ends to a selected, adjustable value; and said distance between clamped conductor ends of said at least two conductors, prior to transfer of said at least two conductors from said feed device to said twist application head, is set to said selected, adjustable value, and said at least two first clamping devices being rotatable relative to one another in said clamping position, and said controller and said drive being configured to rotate said first clamping jaws relative to one another in said clamping position so as to alter said distance between clamped conductor ends.

2. The twist application device of claim 1, wherein each of said at least two first clamping jaws, when located in a fully-open position, define an intermediate space therebetween, and a width of the intermediate space being equal to a length of a clamping surface of the at least two first clamping jaws while a height of the intermediate space being equal to a spacing of said at least two first clamping jaws from one another, when said at least two first clamping jaws are located in the fully-open position, and the width of the intermediate space is at least twice the height of the intermediate space.

3. The twist application device of claim 1, wherein an intermediate space located between said at least two first clamping jaws, when in a fully-open position, has a width which is at least twice as large as a diameter of the conductor ends of said at least two conductors.

4. The twist application device of claim 1, wherein an intermediate space located between said at least two first clamping jaws, when in a fully-open position, has a width, in said direction of movement that allows said distance between clamped conductor ends, which is at least 9 mm, to be altered.

5. The twist application device of claim 1, wherein said adjustable value is selected from at least two different values.

6. The twist application device of claim 1, wherein said twist application head is rotatable about an axis when said at least two first clamping jaws release, and said second clamping jaws clamp said conductor ends of said at least two conductors to thereby twist said at least two conductors together.

7. The twist application device of claim 1, wherein said at least two first clamping jaws have clamping surfaces, facing one another, which are either: (a) essentially flat, or (b) include two or more half-shell shaped grooves that serve to accommodate conductor ends.

8. The twist application device of claim 1, wherein said at least two first clamping jaws have clamping surfaces, facing one another, which include teeth having a height that is (a) less than 3% of a height of an intermediate space between said at least two first clamping jaws, when in a fully-open position, in a clamping direction of said at least two first clamping jaws, or (b) less than 10% of a diameter of said conductor ends.

9. A method for feeding at least two conductors from a feed device to a twist application head, said feed device including at least two first clamping devices, each of the at least two clamping device comprises at least two first clamping jaws and said twist application head including second clamping jaws, the method comprising:

clamping conductor ends of at least two conductors between the at least two first clamping jaws of said feed device;

moving said feed device relative to said twist application head into a transfer position in which the at least two first clamping jaws of said feed device and the second clamping jaws of said twist application head are located opposite one another and rotating said at least two first clamping devices relative to one another;

clamping conductor ends of said at least two conductors with said second clamping jaws;

releasing the at least two first clamping jaws of said feed device to transfer the at least two conductors to said twist application head;

prior to moving said feed device relative to said twist application head into said transfer position, moving said at least two first clamping devices relative to one another in a clamping position in a direction so as to alter a distance between clamped conductor ends to a selected, adjustable value; and setting said distance between clamped conductor ends of said at least two conductors, prior to a transfer of said at least two conductors from said feed device to said twist application head, to said selected, adjustable value, the step of moving said at least two first clamping devices relative to one another in said direction includes rotating said at least two first clamping devices relative to one another.

10. The method of claim 9, wherein said conductor ends are clamped by said at least two first clamping devices individually and in sequence, and are clamped by said second clamping jaws jointly and simultaneously.

11. The method of claim 9, wherein said conductor ends are clamped by said at least two first clamping devices jointly and simultaneously, and are clamped by said second clamping jaws jointly and simultaneously.

12. The method of claim 9, wherein said at least two first clamping jaws, when located in a fully-open position, define an intermediate space therebetween, and a width of the intermediate space being equal to a length of a clamping surface of the at least two first clamping jaws while a height of the intermediate space being equal to a spacing of the said at least two first clamping jaws from one another, when said at least two first clamping jaws are located in the fully-open position, and the width of the intermediate space is at least twice the height of the intermediate space.

13. The method of claim 9, wherein an intermediate space located between said at least two first clamping jaws, when in a fully-open position, has a width which is at least twice as large as a diameter of the conductor ends of said at least two conductors.

14. The method of claim 9, wherein an intermediate space located between said at least two first clamping jaws, when in a fully-open position, has a width, in said direction of movement that allows said distance between clamped conductor ends, which is at least 9 mm, to be altered.

15. The method of claim 9, wherein said adjustable value is selected from at least two different values.

16. The method of claim 9, further comprising, subsequent to the step of clamping conductor ends of said at least two conductors with said second clamping jaws, rotating said second clamping jaws about an axis so as to twist said at least two conductors together.

* * * * *